United States Patent [19]

Proffit et al.

[11] Patent Number: 4,729,315

[45] Date of Patent: Mar. 8, 1988

[54] THIN FILM BRIDGE INITIATOR AND METHOD THEREFOR

[75] Inventors: Robert L. Proffit, Santa Clara County; John L. Wells; Alan L. Lause, both of San Mateo County, all of Calif.; John C. Cole, King County, Wash.

[73] Assignee: Quantic Industries, Inc., San Carlos, Calif.

[21] Appl. No.: 943,380

[22] Filed: Dec. 17, 1986

[51] Int. Cl.[4] ..... F42B 3/12

[52] U.S. Cl. ..... 102/202.9; 102/202.5

[58] Field of Search ..... 102/202.5, 202.9, 202.14, 102/202.12

[56] References Cited

U.S. PATENT DOCUMENTS

| | | | |
|---|---|---|---|
| 3,082,691 | 3/1963 | Evans et al. | 102/202.14 |
| 3,420,174 | 1/1969 | Potter | 102/202.14 |
| 3,426,682 | 2/1969 | Corren et al. | 102/202.9 |
| 4,267,567 | 5/1981 | Nygaard et al. | 102/202.5 |
| 4,335,653 | 6/1982 | Bratt et al. | 102/202.9 |
| 4,409,898 | 10/1983 | Blix et al. | 102/202.5 |
| 4,484,523 | 11/1984 | Smith et al. | 102/202.5 |

FOREIGN PATENT DOCUMENTS

| | | | |
|---|---|---|---|
| 581316 | 8/1959 | Canada | 102/202.5 |

*Primary Examiner*—Charles T. Jordan

*Attorney, Agent, or Firm*—Flehr, Hohbach, Test, Albritton & Herbert

[57] ABSTRACT

A thin film bridge initiator is mounted on a header for use in a detonator where a primer is activated by heat from the thin film. The initiator includes a substrate which carries a pair of metallic beam-type leads connected by a thin film bridge which activates the adjacent primer. The beam-type leads are affixed (welded) to a pair of electrical pins which are on adjacent sides of a slot in the header. The entire structure is very cost effective, reliable and provides fast functioning and safety. In addition, a process of manufacturing several bridge initiators at one time on a single wafer is provided.

7 Claims, 5 Drawing Figures

THIN FILM BRIDGE INITIATOR AND METHOD THEREFOR

The present invention is directed to a thin film bridge initiator and method therefor.

BACKGROUND OF THE INVENTION

Bridge type detonators are commonly used for initiating or firing an explosive such as the various stages of a rocket. Electrical characteristics necessary for such use are a fast function time, repeatability or simultaneity with respect to firing time, cost effectiveness and most importantly, safety. With regard to safety, a standard no fire test for such initiators of the above type is the application of one ampere or one watt to the initiator to insure that no malfunction will occur.

In general operation for a detonator of a the thin film bridge type, a primer such as lead styphnate is placed on the bridge and when sufficient current is passed through the bridge its inherent resistance heating will fire or detonate the primer. Normally the thin film bridge is part of an explosive cap shell which has a pair of leads extending from it to which the electrical firing impulse is provided.

OBJECT AND SUMMARY OF INVENTION

It is a general object of the present invention to provide a bridge-type detonator which has improved repeatability, function time, safety and at the same time is cost effective.

In accordance with the above object, there is provided a method of making a detonator having a bridge initiator and having a header with a pair of electrical pins comprising the steps of providing a header having a slot with adjacent pins having flat ends. A bridge initiator is fabricated with a substrate carrying a pair of metallic beam-type leads connected by a thin film bridge. The initiator is placed in the slot of the header and the beam leads are permanently affixed to the flat ends of the pins. Then the fabrication of the detonator is completed.

From an apparatus point of view, a thin film bridge initiator is mounted on a header for use in a detonator where an adjacent primer is activated by heat from the thin film bridge. It comprises a substrate carrying a pair of metallic beam-type leads connected by a thin film bridge. A slot in the header receives the substrate, the header including a pair of electrical pins adjacent the slot and having ends permanently affixed to the pair of beam leads.

DETAILED DESCRIPTION OF PREFERRED EMBODIMENT

Figure 1:
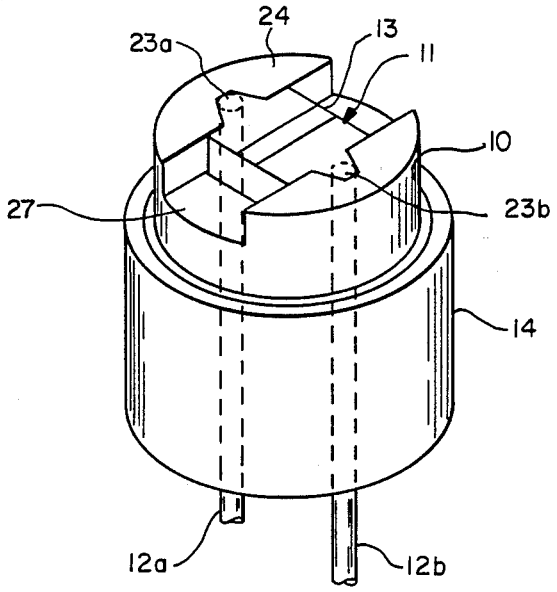
FIG. 1 is a perspective view of a thin film bridge initiator mounted on a header in accordance with the present invention.
Figure 2:
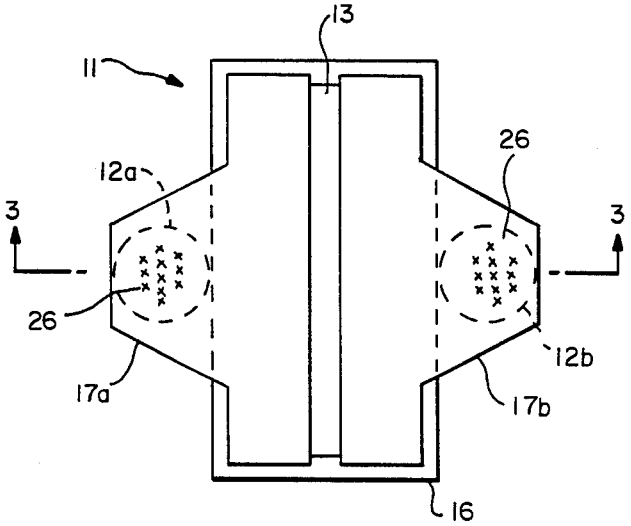
FIG. 2 is an enlarged simplified top view of FIG. 1.
Figure 3:
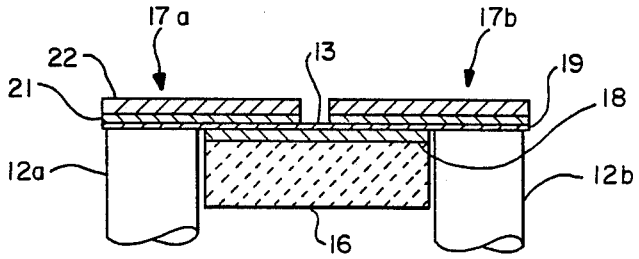
FIG. 3 is a simplified cross-sectional view substantially taken along the line 3—3 of FIG. 2.

FIG. 1 illustrates a header 10 constructed, for example, of bora-silicate glass which has mounted on it a bridge initiator generally indicated as 11. Extending through header 10 are electrical pins 12*a* and 12*b* which are connected to the thin film portion 13 of bridge initiator 11 in a manner to be described below. When a voltage is impressed across leads on pins 12, the thin film bridge 13 is heated and an adjacent primer (to be shown in FIG. 4) is activated by heat from the bridge to perform the ultimate detonation function. As thus far described, the foregoing is a typical and well known thin film bridge type initiator. The header 10 also includes a sleeve 14 of Kovar metal. FIGS. 2 and 3 better illustrate the details of the bridge initiator and its construction and its connection to pins 12*a* and 12*b*. It includes a substrate 16 which is electrically insulating but thermally conductive which carries on it a pair of metallic beam-type leads 17*a*, 17*b* which are carried in a cantilevered manner by substrate 16 and extend through the center of the wafer up to the bisecting area of the thin film 13. Thus, the electrical current passing between pins 12*a* and 12*b* passes through the relatively highly conductive beam leads 17*a* and 17*b* and then to the relatively less conductive thin film bridge 13.

The specific construction of the bridge initiator is illustrated in FIG. 3 where the substrate may be constructed of silicon, germanium, or other electrically insulating thermally conductive materials which can be etched or similarly treated in a typical semiconductor manufacturing process.

As will be discussed below, a semiconductive wafer which is later diced to form the individual substrates, is preferred because of its good anisotropic etching characteristics.

On the top layer of substrate 16 is a passivating layer of silicon dioxide 18. The thin film layer 19 is constructed of a conductive material such as chromium. On top of this layer is a nickel layer 21 and then a gold layer 22. The thin film bridge area 13 may have a passivating surface or protective surface such as beryllium oxide.

With the use of the nickel and gold layers 21 and 22, to form the beam leads 17*a*, 17*b*, resistance is much much lower than the critical thin film portion 13 which typically may be one ohm. Thus, when electrical current passes between the two beams the only significant heating effect occurs in this thin film area 13.

As illustrated in FIG. 3, the beam leads 17*a* and 17*b*, or more specifically that portion of the leads which are cantilevered out beyond the substrate 16 are, in effect, flat metallic leads which are similar to beam leads utilized as a connecting lead for a semiconductor device for an integrated circuit. The beam lead is sufficiently thick in order to provide structural rigidity for handling and specifically for welding onto the flat ends of pins 12*a* and 12*b*. As is illustrated in FIG. 1, the flat ends 23*a* and 23*b* of the pins are coplanar or flush with the top 24 of header 10. And the pins 12*a* and 12*b* are located in holes which have been drilled through the header 10.

As best illustrated in FIGS. 2 and 3, when the beam leads themselves are affixed to these flat ends 23*a* and 23*b* by a standard resistance welding process, the welding points being indicated, for example, at 26 by the "x's", this provides a superior connection compared to soldering a bridge initiator wire in some manner or by the use of wire bonding. For example, when soldering the soldering flux may produce subsequent outgasing and the soldering itself may induce stresses to cause etching of the film.

Substrate 16, as illustrated in FIGS. 2 and 3, has a width dimension which is substantially equal to the width of a slot 27 which is cut in the top of header 10. Also the thickness of substrate 16 is substantially equal to the depth of the slot. The flat ends 23*a* and 23*b* of the pins are made coplanar with the surface 24 by an initial placement or a grinding. Pins 12*a* and 12*b* are, of course, adjacent slot 27 to facilitate the affixing of beam leads to the flat ends of the pins.

Figure 4:
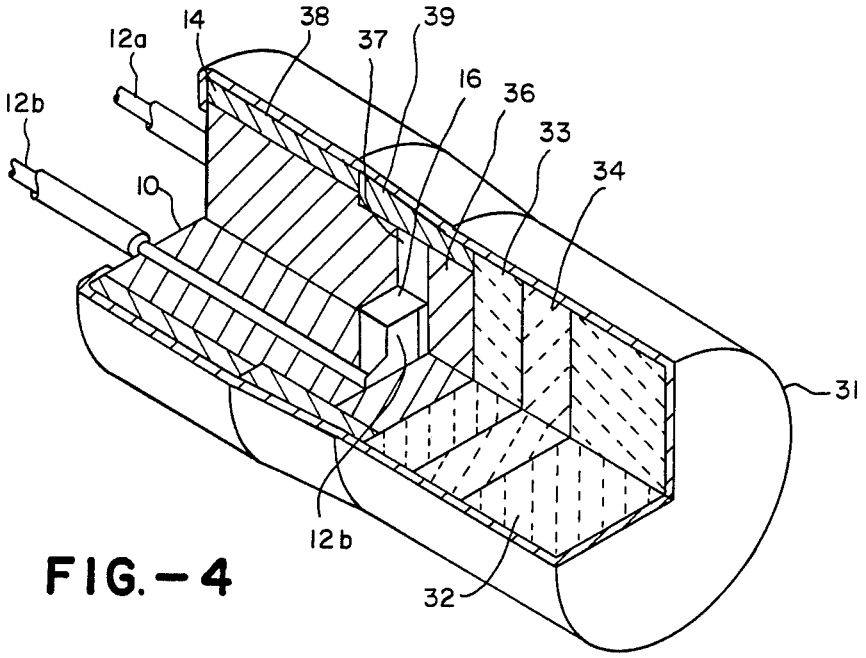
FIG. 4 is a perspective view partially cut away of a cap shell incorporating the structure of FIG. 1.

The structure of FIG. 1, when integrated into an overall detonator, is better shown in FIG. 4. In general, the formation of a detonator includes the provision of the cap shell 31 into which is placed a PETN type explosive 32. Then two layers of lead azide of differing density, 33 and 34, are pressed in. Then the header 10 with the substate 16 has a primer charge such as a styphnate 36 applied to its top surface 24 including thin film bridge 13 and the beam leads 12*a* and 12*b* and this entire assembly is pressed against the lead azide layer 33 to consolidate it. Potting at 37, 38, 39, is provided to fill in the space between the shell 31 and the remainder of header 10. Thereafter the end of the shell 31 is crimped around the back side of header 10 and the detonator is complete.

Figure 5:
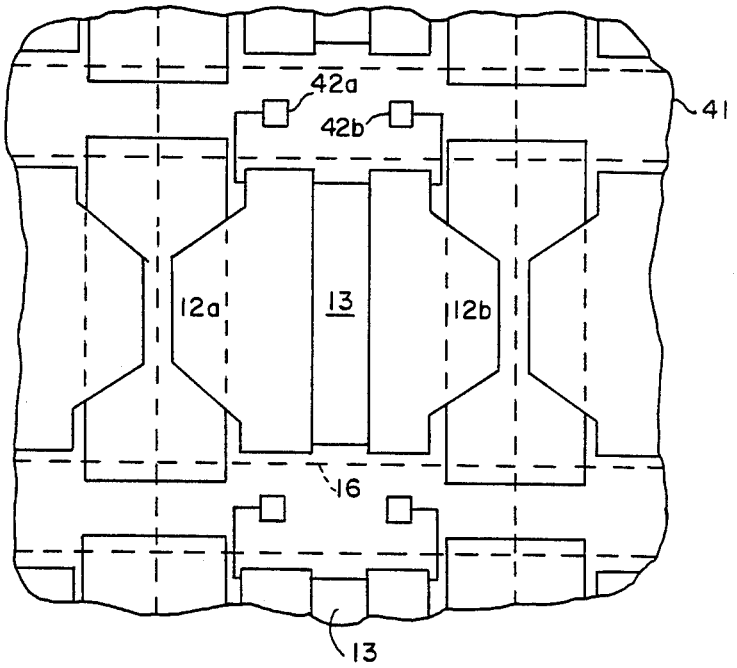
FIG. 5 is a plan view of a semiconductive wafer illustrating the process of fabrication of the bridge initiator of the present invention.

FIG. 5 illustrates the technique of fabrication of the bridge initiator unit 11. In actual practice, a relatively large semiconductor wafer 41 is utilized and several initiators are fabricated on this common wafer at the same time. Also, for each individual initiator, the electrical test pads, for example, illustrated at 42*a*, 42*b*, provide a way of testing the thin film bridge 13 for accurate resistance and continuity before the bridge initiator is installed in its slot and header. This, thus, saves in production costs. After measurement of resistance those bridges which are out of tolerance are marked for disposal.

In general, the process steps used to construct the specific bridge initiator of the present invention are very similar to those used in semiconductor processing for beam lead devices. Thus the technology is fairly well known.

Referring specifically to the process for creating a plurality of bridge initiators on the single wafer 41, the wafer is first cleaned and a thermal oxide is grown over it. Next, thin films of chromium and nickel are added. The nickel serves to prevent gold diffusion and acts as a barrier. Thereafter a photo resist is applied and patterned to expose the beam lead areas 12*a*, 12*b*. Beams are then electroplated, for example, by a gold layer 22 or other suitable metal, to the desired thickness to provide structural rigidity. Next the remaining photoresist is stripped off and the exposed niclel is etched away to expose the chromium layer. Again, by the use of photoresist, the layer is patterned to form the specific bridge geometry 13, pads 42*a*, 42*b*, and the connecting conductors.

The wafer is then baked at an elevated temperature, developing a passivation film on the bridge (chromium dioxide) and causing the chromium/nickel/gold interfaces to form ohmic contacts. Alternatively, beryllium oxide may be deposited to form a passivation layer. Next the wafer is probed to measure bridge resistance at, for example, the gold beam leader and the pads 42*a* and 42*b* and the chips with defects are marked. A clear polymer film is applied to the surface and cured. The film will remain on the surface supporting the beams and protecting the bridge 13 until the units are assembled in headers.

Finally and most importantly, the oxide on the backside of wafer 41 is patterned. The individual substrates on dice as illustrated in FIGS. 2 and 3 are then formed by etching the silicon from the back side using an anisotropic etch, leaving the individual substrates, for example 16, connected by a matrix of silicon and leaving the ends of the beam leads 12*a*, 12*b* cantilevered from the semiconductive wafer 16.

The wafer is then bonded to a sticky tape and sawed along the dashed lines illustrated in FIG. 5. Individual dice are then cleaned, sorted and removed from the tape and installed in the headers as discussed above. Before final assembly in the headers, the protective polymer coating is dissolved.

Thus, the above process provides a technique of inexpensively manufacturing bridge initiators which provide a repeatable fast functioning time. Thereafter, by the technique of fixing the bridge initiator by means of the beam-type leads, a very effective connection is made without the deleterious effects caused by the prior art soldering or numerous wires.

What we claim is:

1. A method of making a detonator utilizing an explosive containing shell having a bridge initiator for activating an adjacent primer and having a header with a pair of electrical pins comprising the following steps:

providing a header having a slot with adjacent said pins having flat ends;

fabricating a bridge initiator with a substrate carrying a pair of metallic beam-type leads connected by a thin film bridge;

placing said initiator in said slot of said header and permanently affixing said beam leads to said flat ends of said pins;

and completing fabrication of said detonator, including applying said primer to said initiator and placing said header in said explosive containing shell.

2. A method as in claim 1 including the step of making said flat ends of said pins coplanar with a portion of said header.

3. A method as in claim 1 including the step of testing said fabricated initiator before placing said initiator in said slot of said header.

4. A method as in claim 1 where in said step of fabricating said initiator a plurality of initiators are fabricated on a common wafer.

5. A method as in claim 1 where said beam leads have a thickness to provide structural strength for said affixing step.

6. A thin film bridge initiator mounted on a header for use in a detonator where an adjacent primer is activated by heat from said thin film bridge comprising:

a substrate carrying a pair of metallic beam-type leads connected by a thin film bridge;

a slot in said header for receiving said substrate, said header including a pair of electrical pins adjacent said slot and having flat ends permanently affixed to said pair of beam leads.

7. An initiator as in claim 6 where the depth of said slot in said header is substantially equal to the thickness of said substrate.

* * * * *